US005556353A

United States Patent [19]

Beers

[11] Patent Number: 5,556,353

[45] Date of Patent: Sep. 17, 1996

[54] TETHERED LASSO FOR STATIONARY SWIMMING

[76] Inventor: John A. Beers, 18605 McCoy Ave., Port Charlotte, Fla. 33948

[21] Appl. No.: 305,209

[22] Filed: Sep. 13, 1994

Related U.S. Application Data

[63] Continuation-in-part of Ser. No. 125,740, Sep. 24, 1993, abandoned.

[51] Int. Cl.[6] ..... A63B 69/12; A63B 21/04

[52] U.S. Cl. ..... 482/55; 482/122

[58] Field of Search ..... 482/124, 74, 55, 482/123, 125, 121, 122, 904, 129, 120, 126

[56] References Cited

U.S. PATENT DOCUMENTS

| | | | |
|---|---|---|---|
| 1,998,226 | 4/1935 | Draheim | 482/121 |
| 4,109,905 | 8/1978 | Meier | 482/55 |
| 4,247,096 | 1/1981 | Schmitt | 482/55 |
| 4,544,155 | 10/1985 | Wallenbrock et al. | 482/121 |
| 4,570,929 | 2/1986 | Shoemaker | 482/125 |
| 4,944,518 | 7/1990 | Flynn | 482/904 |
| 5,344,373 | 9/1994 | Greene | 482/55 |
| 5,431,617 | 7/1995 | Rattray | 482/121 |

*Primary Examiner*—Stephen R. Crow
*Attorney, Agent, or Firm*—Frank A. Lukasik

[57] ABSTRACT

A device for in-place swimming in a swimming pool. A swimmer is tethered to the side of a pool in a manner which permits unrestrained swimming by an elongated, smooth, slightly elastic, strap having an eye formed on one end by bending the end back on itself and sealing the end in place and forming a running slip knot by pulling the strap material through the eye to form a lasso type loop for restraining the lower body of the swimmer.

4 Claims, 4 Drawing Sheets

TETHERED LASSO FOR STATIONARY SWIMMING

RELATED APPLICATIONS

This application is a continuation-in-part of patent application Ser. No. 08/125,740, filed Sep. 24, 1993, now abandoned.

BACKGROUND OF THE INVENTION

1. Field of the Invention

This invention relates to swimming pool exercising equipment in general and more particularly to a swimming pool exercise device with which a user can exercise freely while using only a small portion of a swimming pool.

2. Discussion of the Prior Art

The therapeutic and aerobic effects of swimming as an exercise are indisputable. Experts in the field rank it highly, however, the frequent turning required when swimming laps in a swimming pool-whether large or small is bothersome, especially for the inexpert swimmer. Additionally, it detracts from the aerobic benefit where a prolonged, uninterrupted activity is recommended. Obviously, the smaller the pool is, the greater this problem of frequent turning becomes. While this problem is reduced somewhat in larger, semi private or public pools, there are still problems of lane and space availability to consider. Most swimming pools in homes, hotels, condominiums, etc. are simply too small and/or, in many cases, too crowded to accomodate this exercise in a satisfactory manner.

Therefore, a compact, readily portable means that would enable a swimmer to go through all the motions of the various strokes in a prolonged, uninterrupted manner while being restricted to only a small portion of a pool would permit an individual to exercise in any available pool-small or large, public or private-without being distracted by frequent turns or bothering, (or being bothered by) competing swimmers.

There are several devices of prior art on record that employ the concept of "tethered swimming" for swimming exercise and training. One such apparatus is disclosed by U.S. Pat. No. 3,988,020 to Carter which discloses a device which includes at least two flexible lines, the second end of each line is attached to an anchoring structure at the side of the pool or the like and the first end of each line is attached to a belt which is disposed above and encircles the waist of the swimmer and attached to the belt is a plurality of pads with a plurality of straps attached to each pad for securing the position of the belt about the waist of the swimmer and for securing the position of the first end of each line.

U.S. Pat. No. 4,109,905 to Meier discloses a device to be used in a swimming pool for in place swimming. The device consists of a foam rubber belt attached to a flexible cord. The belt is placed around the abdomen of a swimmer and the cord is secured to the side of the pool. The swimmer then practices swimming strokes in place against the restraint of the cord. The belt is water absorbent so that it acts as a cushion against the body of a swimmer. This prevents slipping and excessive pressure on the swimmer's body.

U.S. Pat. No. 4,524,711 to Ashrow discloses a swimming harness for holding a swimmer at a selected location in a swimming pool, yet giving the swimmer freedom of swimming movement. The swimming harness comprises an elongated member, the inner end of which is attached to a fixed exterior object and the outer end of which is connected to a belt which is to be located about the waist of the swimmer. A resilient section is located between the inner and outer ends of the members to provide a limited amount of stretching movement.

U.S. Pat. No. 4,544,155 to Wallenbrock et al discloses an exercise device with stretchable elastomeric line comprising elastomeric tubing, first and second connections attached to opposite end sections of the tubing, one of the connections connectable to a restraint, and a harness attached to the second connection, the harness being flexible for releasable attachment to a portion of the human body.

U.S. Pat. No. 4,247,096 to Schmitt discloses a flexibly tethered swimming apparatus, designed primarily for the purpose of training swimmers. The Schmitt apparatus consists of a broad, heavy duty belt secured about the user's waist by Velcro, a length of inflexible tether means, attached to a secondary spring tethered section, which is attached to an adjustable frame overhanging a pool. Although it appears to work well as a training apparatus, it would be difficult for the average business traveler to carry around to use in motel pools, and would greatly and continuously obtrude upon the aesthetics and everyday usage of any swimming pool whether public or private.

All of the above prior art devices are relatively cumbersome and involve some sort of "belt means" attached by rings, hooks or other methods to an independent fixed point by some sort of stretchable "tether means". The present invention greatly simplifies and uniquely improves upon anything existent in the prior art. In addition, it is compact, lightweight, economical, very versatile, and easy to use.

Another improvement over the prior art inherent in the present invention is its versatility: it can be worn about the mid-section, above the hips, affixed to a bathing suit, or attached about the thighs. A problem experienced by most, if not all mid-section-belted, tethered swimmers, is that as one swims, it becomes increasingly difficult to maintain a "swimmers plane" because one's lower body, thighs and legs all act as a drag. In this regard, the tether point serves somewhat as a fulcrum: so that the less of the body that is ahead of the tether point the more there is to act as a drag behind it. The present invention greatly overcomes this drag problem by being easily affixable further down one's body, and thus placing the bulk of the user's weight ahead of the tether point. None of the prior art devices possesses or claims such versatility.

SUMMARY OF THE INVENTION

The present invention is directed to a swimming pool exercising device with which a swimmer can receive the benefit of swimming seemingly long distances while confined in a small portion of a swimming pool area. The aquatic apparatus of the present invention overcomes the disadvantages of the above mentioned prior art in that the present invention discloses a swimming exercise or training apparatus for use in a swimming pool, or the like, and which consists of a single strip of very strong, soft, pliable, vinyl material that can be worn about a swimmer's lower waist or hips, attached to a swimmer's bathing suit, or easily configured in such a way as to permit attachment to a user's thighs.

A primary objective of the present invention is to provide a tethered swimming device that is low cost, simple, compact, lightweight, readily portable, and versatile that will fit persons of all sizes without regard to age group, gender, or swimming proficiency.

Another object of the invention is to provide a device that can be used in a small swimming area and yet allow the swimmer to exercise or practice all swimming strokes indefinitely and thereby develop endurance, rhythm and aerobic benefits, without having to repeatedly turn and change direction.

A still further object of the present invention is to provide a swimming exercise and training apparatus that does not artificially support the swimmer.

Another object of the present invention is to provide a simple, non-cumbersome, and non-bulky device that is portable, need not be permanently anchored to the side of the pool or create an obstacle for others in and about the pool area.

Yet a further object of the present invention is to provide a simple aquatic apparatus capable of use by swimmers of all age groups with widely varying degrees of proficiency in swimming from the untrained novice through the professional swimmer.

These and other objects of the invention will become apparent to those skilled in the art to which the invention pertains when taken in light of the annexed drawings.

DESCRIPTION OF THE PREFERRED EMBODIMENT

Figure 1:
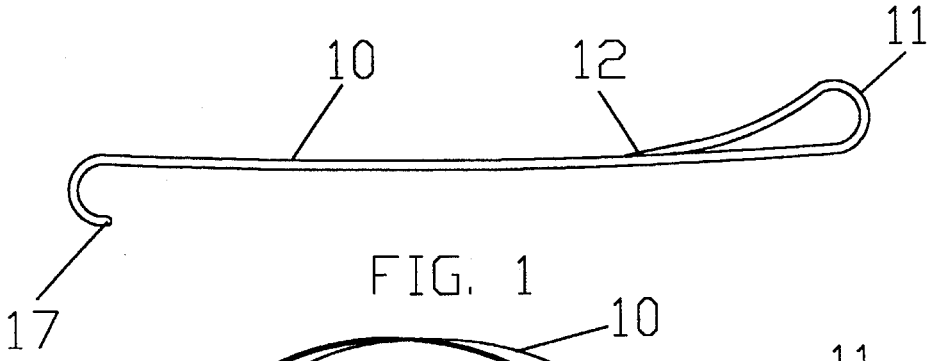
FIG. 1 is a perspective view of a swimming exercise device of the present invention.

Referring to FIG. 1, the present invention comprises a single strip of slightly stretchable vinyl, or similar material, strap 10. In general, a twelve to twenty foot length should suffice for most circumstances, however, if a greater length were required, any handy piece of rope, (such as clothesline cord) could be employed to extend the range. The width of the vinyl strip may be approximately three quarters of an inch, and the thickness approximately 0.025 to 0.050 inches. In a preferred embodiment, a thickness of 0.03 was used. A four to six inch eye 11 is fashioned at one of its ends by bending the material back on itself and cementing or heat sealing it in place as shown at 12.

Figure 2:
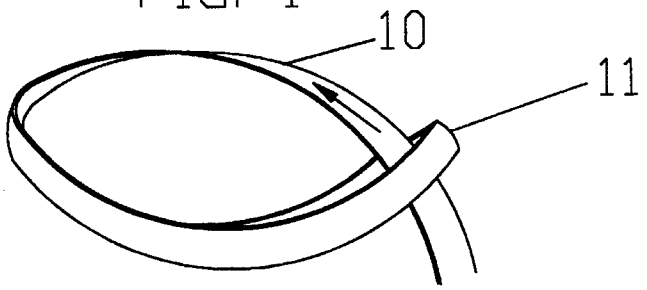
FIG. 2 is a perspective view of a lasso type loop of the present invention.
Figure 3:
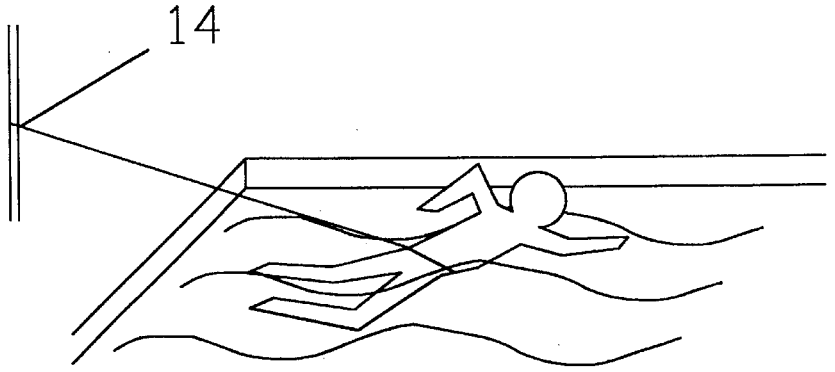
FIG. 3 is a perspective view of a swimming exercise device of the present invention as worn by a swimmer.
Figure 4:
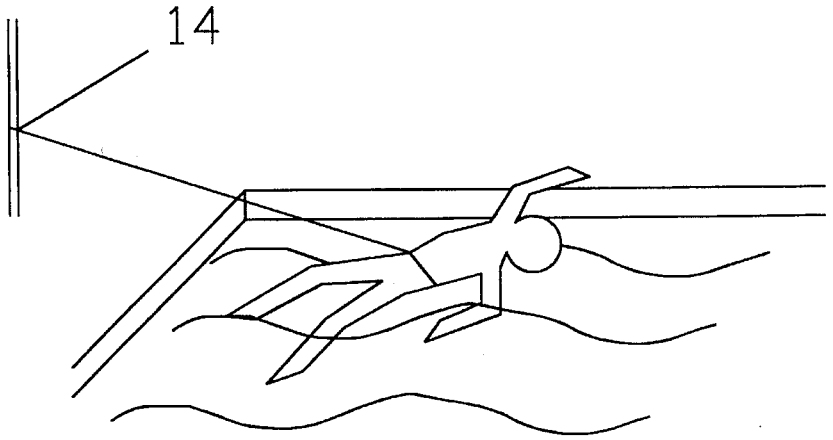
FIG. 4 is a perspective view of a swimming exercise device of the present invention with the swimmer in a backstroke position.

By holding the eye 11 open with one hand, and reaching through it with the other, to grasp and pull a bight of the vinyl material strap 10, back through the eye, a running slip knot, or lasso type loop 13 is formed (FIG. 2). The free end 17 of the tether is tied off, as shown in FIGS. 3, 4, 7, and 8 at a convenient fixed point, such as a roof support post 14, or a pool ladder, or any convenient fixed object near the pool. The user then steps into the loop 13 or pulls the loop 13 over the shoulders and fits the loop 13 loosely about the mid section, just above the curve of the hips. Most of the slack is then drawn out by moving away from the tether, and it is adjusted so that it leads from the longitudinal center of the body, from above the lower backside, if swimming freestyle, butterfly, or dog paddle, FIG. 3, or from above the groin area FIG. 4, if swimming the backstroke. The thin vinyl material strap 10 will conform and cling perfectly to the user's body, and remain in place as long as there is the slightest tension on the tether strap 10, and the user can then proceed to swim at the pace he or she chooses for as long as desired.

Figure 5:
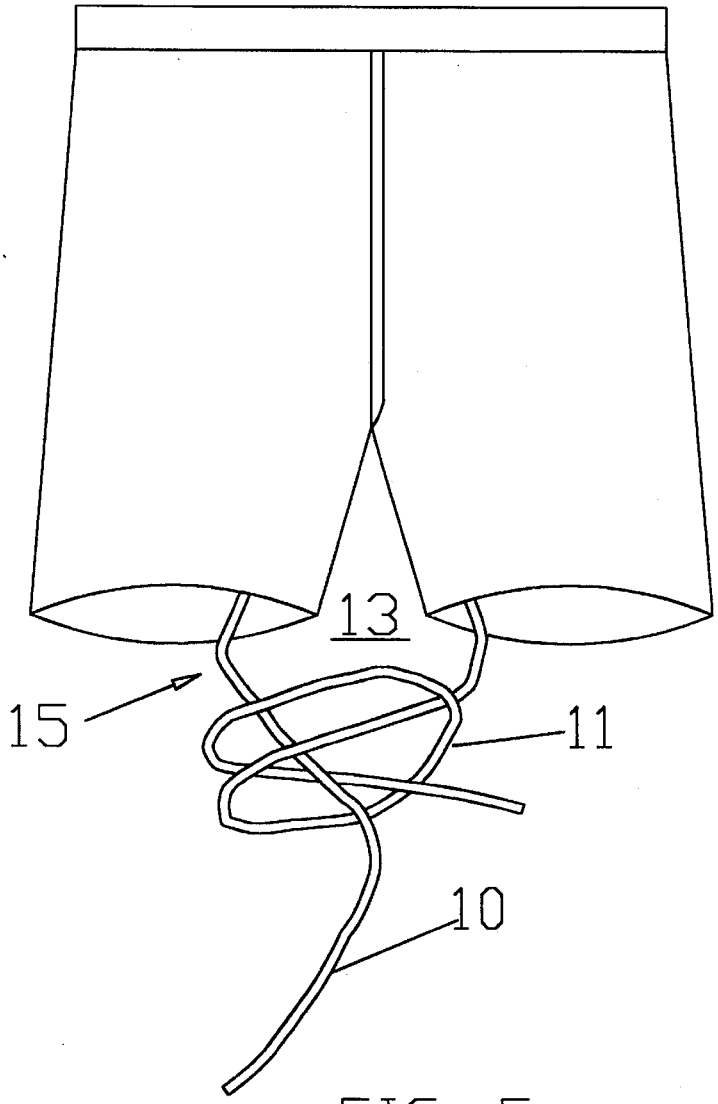
FIG. 5 is a perspective view of a swimming device of the present invention attached to the crotch of a bathing suit.

Swimmers, who when using the above method, find it difficult to maintain a "swimmers plane" because of the tendency of the lower body to drag and sink, may prefer affixing the tether to the crotch of their bathing suit by threading the eye 10 and some of the tether 11 up one leg of the suit and down the other and then tying it back onto itself with two half hitches as shown in FIG. 5. With the suit tied to the tether 10 and the free end 17 tied off as shown in FIG. 5 the user is free to swim away—backstroke, free style, butterfly, dogpaddle—with whichever stroke is preferred. The pull of the tether strap 10 does not tend to pull the suit off, but rather it tends to draw the suit tighter about the waist and hips. The advantages of this option are that they give the user the ability to swim whichever type stroke he/she may prefer without resetting the lead of the tether strap 10 from front to rear as described above and, at the same time, bring the tether point further down the body and thus reducing the drag.

Figure 7:
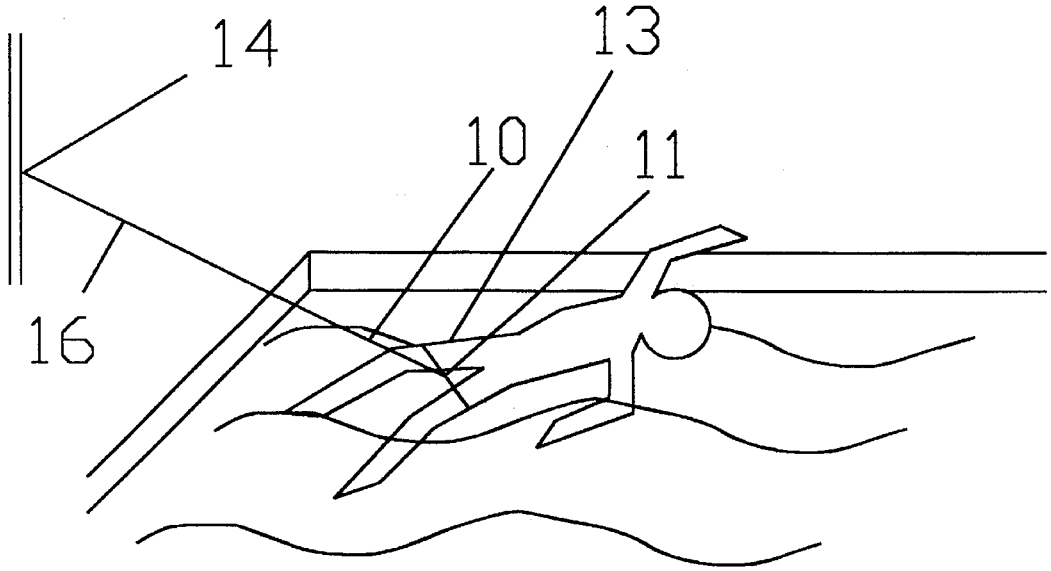
FIG. 7 is a perspective view of the present invention with the swimmer in the backstroke position with the invention looped into two parts about the swimmer's thighs.
Figure 8:
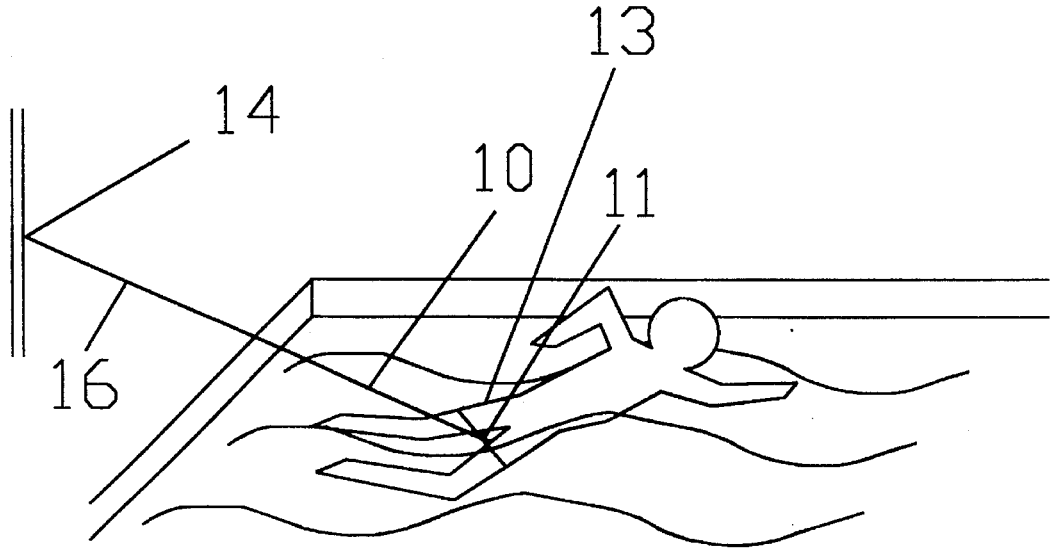
FIG. 8 is a perspective view of the present invention with the swimmer in a crawl position with the invention looped into two parts about the swimmer's thighs.
Figure 9:
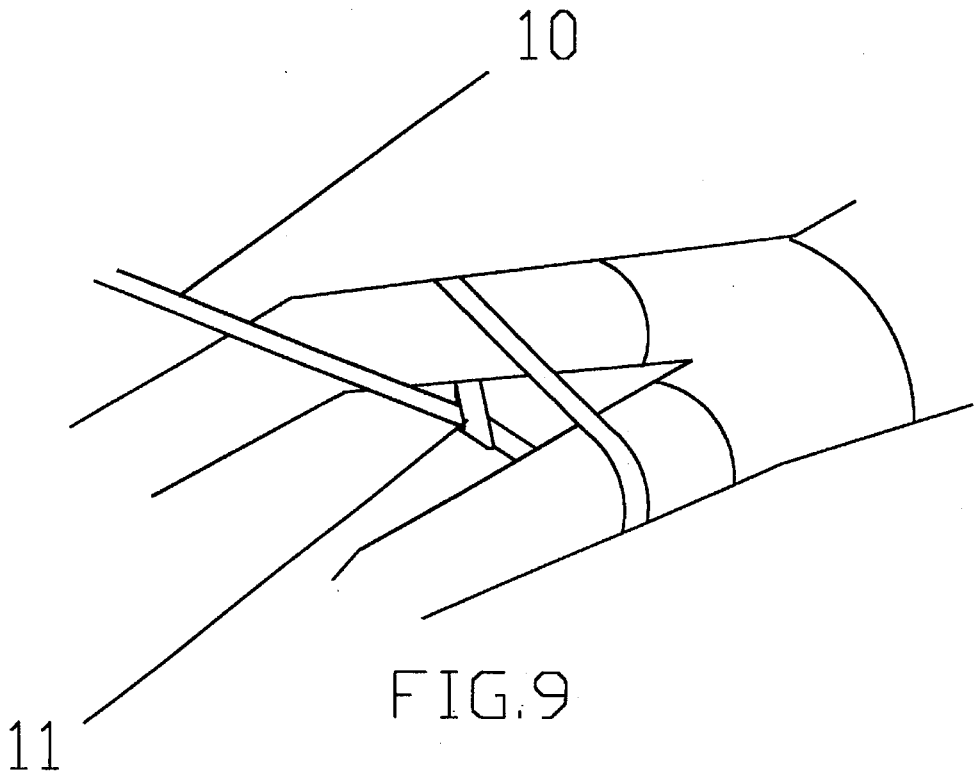
FIG. 9 is a close-up view of the present invention with the swimmer in the backstroke position.
Figure 10:
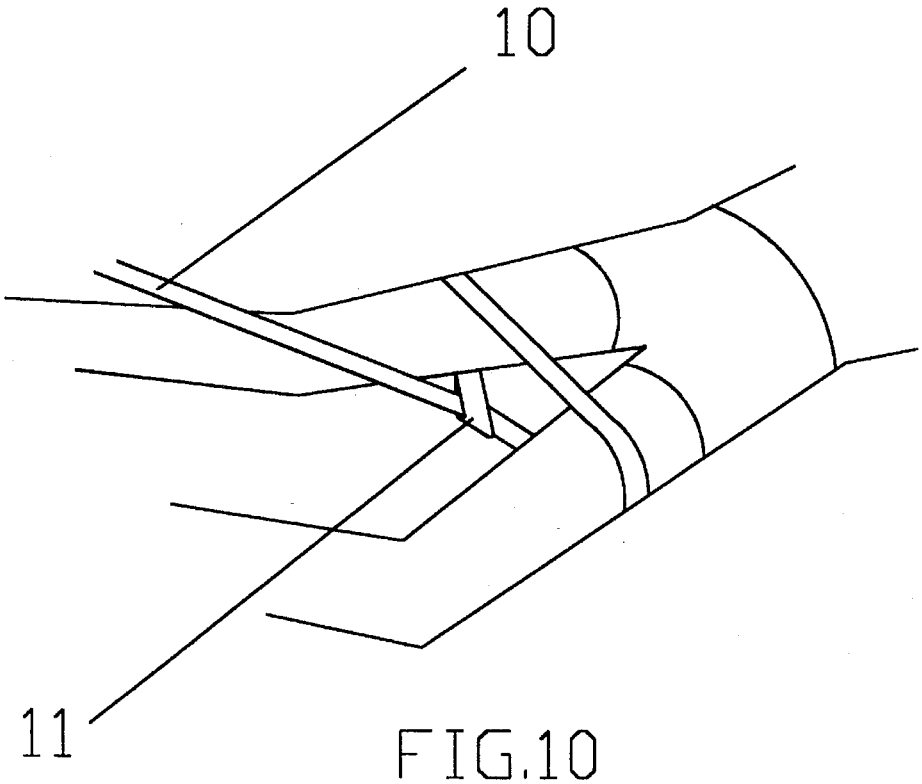
FIG. 10 is a close-up view of the present invention with the swimmer in a crawl position.

Yet another method of using this device is available whereby the user is able to divide the lasso loop 13 effectively into two parts that individually encircle each thigh just above the knee, and then arrange it so that the tether 10 and eye 11 lead from between the thighs away from the front part of the user's body, FIGS. 7 and 9, if doing the backstroke or swimming face up; or from between the thighs, away from the rear side of the user's body, FIGS. 8 and 10, if swimming freestyle, or face down.

The above configurations are accomplished by the user first tying off the free end 17 (FIG. 1), of the tether 10 to a fixed point such as post 14 (FIGS. 3 and 4), and then stepping into the lasso loop 13 while facing the eye 11 and tether 10, and then pulling the lasso loop 13 up just above the knees, and then removing most of the slack by backing away from the tether 10; and then, depending on one's choice of swimming style, proceeding as follows:

TO SWIM FACE UP OR BACKSTROKE

With the left hand, the swimmer pinches the tether 10 and eye 11 together to prevent slippage, with the right hand, the opposite side of the lasso loop 13 is grasped, and the eye 11 and the lasso loop 13 are rotated leftward 180° around the outside of, and toward the rear of the thighs, while swinging the left leg backwards, (counterclockwise) over the tether 10. The swimmer will be still facing the tether 10; the eye 11 and the tether 10 will then be leading from between the front of the swimmer's thighs, and the lasso loop will be divided in such a way as to encircle each thigh. The swimmer need then only remove any remaining slack; adjust the tether 10, eye 11, and lasso loop 13 for comfort, and thrust himself or herself backward and begin swimming.

TO SWIM FACE DOWN OR FREESTYLE

Most of the slack is removed from the lasso loop 13, the tether 10 and the eye 11 are pinched together with the right hand to prevent slippage, and while the eye 11 and lasso 13 are held just above the knees between the front of the thighs, the body is pivoted, within the loop 11, 180° to the right on the right leg, while swinging the left leg over the tether 10; then as the turn progresses, the tether 10 is passed from the right hand's grasp between the front of the thighs to the left hand's grasp at between the rear of the thighs. When the 180° turn is completed, the swimmer will be facing away from and straddling the tether 10 and eye 11 will be leading from front to back between the user's thighs, and the lasso loop 13 will be divided in such a way as to encircle each thigh. The swimmer need then only remove any remaining slack, adjust tether 10, eye 11 and lasso loop 13 for comfort, and throw himself or herself forward and begin swimming.

Figure 6:
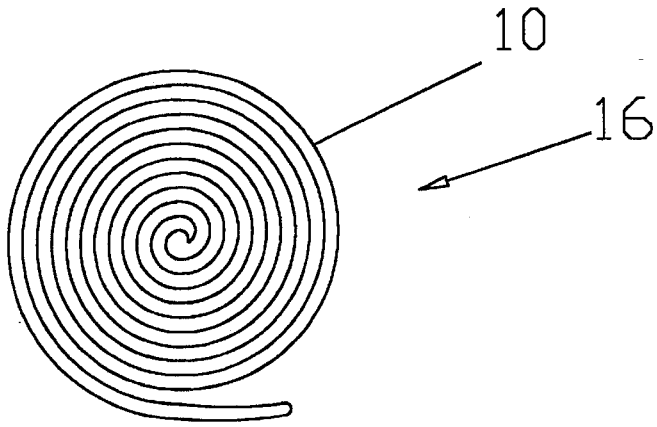
FIG. 6 is a top plan view of a swimming device of the present invention in the portable condition.

FIG. 6 shows the vinyl material strap 10 wrapped in a roll 16, for easy portability to various sites. When wrapped on itself, as shown in FIG. 6, the diameter of the roll 16, of the material described above, does not exceed three and a half inches. Because of the compact size of the present invention, the usefulness is unlimited. For example, an entire college or high school swim team may fit into a standard size pool to swim their required training laps. Furthermore, the added restraint provided by the tension provided by a flexible tether will provide additional strength conditioning for the swimmers. Also, the compact size of the tether strap 10 makes it possible to be carried in a pocket or suitcase and available for instant use wherever the swimmer has access to a swimming pool, including the typical small pools available at motels or cruise ships.

Swimming with the present invention is a new experience and one that provides unlimited opportunities for exercise. Unlike normal, untethered swimming, as a user begins to stroke the water, the tethered strap 10 stretches slightly and some forward movement is momentarily allowed, but as the tethered strap 10 contracts, forward movement is arrested, and the user is held back, so that his stroke is completed where it began. The user has not gone anywhere, but he has exerted effort in trying, and his leg and arm muscles have gone through the same range of motion that they would have, had they been in the open waters.

While I have shown and described embodiments of this invention in some detail, it will be understood that this description and illustrations are offered merely by way of example, and that the invention is to be limited in scope only by the appended claims.

What is claimed is:

1. A device for holding a swimmer in a selected location in a swimming pool in a manner that permits unrestrained swimming strokes comprising:

a single strip of smooth, stretchable vinyl strap material having a first end and a second end, said material having a sufficient length to enwrap a swimmer and to reach a fixed object near the pool, said vinyl strap having a width in the range of five eights to three quarters of an inch, and a thickness between 0.025 to 0.050 inches, a first end tied off to a fixed object near the swimming pool, a second end having an eye formed thereon by bending said material back on itself and sealing said end in place, said eye being in the range between four to six inches in diameter, and, a running slip knot formed on said second end by pulling said strap material through said eye to form a lasso type loop, said loop being placed around a first position on a swimmer's lower body for a first style of swimming stroke, and said loop being placed around a second position on a swimmer's lower body for a second style of swimming stroke, for wrapping around the swimmer's body and restraining the lower body of said swimmer, whereby said vinyl strap material will conform to a swimmer's body and remain in place when tension is continued by said swimming strokes.

2. A device for holding a swimmer as defined in claim 1 wherein a knot is formed through the crotch of said swimmer's bathing suit.

3. A device for holding a swimmer as defined in claim 1 wherein said second position of said lasso type loop is divided into two equal parts by rotating said loop leftward 180° around the outside of, and toward the rear of the thighs, while swinging the left leg backwards, over said tether, each part encircling one thigh of said swimmer.

4. A device for holding a swimmer as defined in claim 1 wherein said vinyl strap material is formed into a roll for easy portability to various sites, said roll having a diameter between two and one half inches and five inches.

* * * * *